US011282662B2

(12) United States Patent
Hofsaess

(10) Patent No.: US 11,282,662 B2
(45) Date of Patent: Mar. 22, 2022

(54) TEMPERATURE-DEPENDENT SWITCH

(71) Applicant: Marcel P. Hofsaess, Steintahleben (DE)

(72) Inventor: Marcel P. Hofsaess, Steintahleben (DE)

( * ) Notice: Subject to any disclaimer, the term of this patent is extended or adjusted under 35 U.S.C. 154(b) by 0 days.

(21) Appl. No.: 17/021,049

(22) Filed: Sep. 15, 2020

(65) Prior Publication Data

US 2021/0090832 A1 Mar. 25, 2021

(30) Foreign Application Priority Data

Sep. 20, 2019 (DE) ..... 10 2019 125 450.7

(51) Int. Cl.
*H01H 37/52* (2006.01)
*H01H 37/04* (2006.01)
*H01H 9/04* (2006.01)

(52) U.S. Cl.
CPC ..... *H01H 37/52* (2013.01); *H01H 9/04* (2013.01); *H01H 37/04* (2013.01)

(58) Field of Classification Search
CPC .... H01H 37/52; H01H 37/04; H01H 37/5427; H01H 9/04; H01H 37/64; H01H 37/54; H01H 2223/002
See application file for complete search history.

(56) References Cited

U.S. PATENT DOCUMENTS 5,877,671 A 3/1999 Hofsaess
5,973,587 A * 10/1999 Hofsaess ..... H01H 1/504 337/333
6,100,784 A * 8/2000 Hofsaess ..... H01H 11/0056 337/333
6,249,211 B1 * 6/2001 Hofsaess ..... H01H 1/504 337/333
8,536,972 B2 9/2013 Hofsaess
9,355,801 B2 * 5/2016 Hofsaess ..... H01H 37/54
9,691,576 B2 * 6/2017 Mitschele ..... H01H 1/504
10,541,096 B2 1/2020 Hofsaess
2013/0062837 A1 * 3/2013 Sasaki ..... H05K 7/00 277/650

(Continued)

FOREIGN PATENT DOCUMENTS

DE 4139091 A1 8/1993
DE 19623570 A1 1/1998

(Continued)

*Primary Examiner* — Stephen S Sul
(74) *Attorney, Agent, or Firm* — Reising Ethington, P.C.

(57) ABSTRACT

A temperature-dependent switch having a housing that comprises a cover part and an electrically conductive lower part. The switch further comprises a first external contact surface arranged on the upper side of the cover part, and a second external contact surface provided externally on the housing. Still further, the switch comprises a temperature-dependent switching mechanism that is arranged in the housing and that, depending on its temperature, establishes or opens an electrically conductive connection between the first and the second external contact surfaces. A circumferential cutting burr acting as a sealing means is furthermore provided, that penetrates into the insulating foil or the cover part, wherein the cutting burr is arranged on a sealing ring that is connected to the lower part by means of a non-positive, positive and/or firmly bonded connection.

20 Claims, 5 Drawing Sheets

(56) References Cited

U.S. PATENT DOCUMENTS

| | | | | |
|---|---|---|---|---|
| 2013/0127586 | A1* | 5/2013 | Hofsaess | H01H 37/5427<br>337/365 |
| 2014/0168844 | A1* | 6/2014 | Liehr | H01H 37/002<br>361/103 |
| 2015/0061818 | A1* | 3/2015 | Klaschewski | H01H 37/54<br>337/343 |
| 2015/0342072 | A1* | 11/2015 | Nishina | C22C 5/08<br>277/630 |
| 2017/0062160 | A1* | 3/2017 | Hofsaess | H01H 37/54 |

FOREIGN PATENT DOCUMENTS

| | | | |
|---|---|---|---|
| DE | 102009039948 | A1 | 3/2011 |
| DE | 102013102006 | A1 | 8/2014 |
| DE | 102013102089 | B4 | 9/2014 |
| DE | 102015110509 | A1 | 1/2017 |
| DE | 102015114248 | B4 | 3/2017 |

* cited by examiner

TEMPERATURE-DEPENDENT SWITCH

CROSS REFERENCE TO RELATED APPLICATIONS

This application claims priority from German patent application DE 10 2019 125 450.7, filed on Sep. 20, 2019. The entire content of this priority application is incorporated herein by reference.

BACKGROUND

This disclosure relates to a temperature-dependent switch.

An exemplary temperature-dependent switch is disclosed in DE 10 2015 114 248 B4.

In practice, such a temperature-dependent switch is used to monitor the temperature of a device. For that purpose it is, for example, brought into thermal contact through its external surfaces with the device to be protected, so that the temperature of the device to be protected affects the temperature of the switching mechanism.

The switch is typically connected electrically in series in the power supply circuit of the device to be protected by means of connecting wires soldered to its two external contact surfaces so that the supply current to the device to be protected flows through the switch when below the response temperature of the switch.

The switch disclosed in DE 10 2015 114 248 B4 comprises a lower part, in which an internal, circumferential shoulder is provided, on which the cover part rests either directly or with the interposition of an insulating foil. The cover part is held firmly against this circumferential shoulder through a circumferential raised wall of the lower part, whose upper section is bent radially inwards.

The temperature-dependent switching mechanism of the switch disclosed in DE 10 2015 114 248 B4 comprises a snap-action spring disc, which carries a movable contact part, as well as a bimetal snap-action disc which is put over the movable contact part. The snap-action spring disc presses the movable contact part against a stationary counter-contact inside on the cover part. The snap-action spring disc is supported by its edge in the lower part of the housing, so that the electrical current flows from the lower part through the snap-action spring disc and the movable contact part into the stationary counter-contact, and from there into the cover part.

The location of the two external terminals differs depending on the design of the temperature-dependent switch. If the cover part is made of an electrically conductive material, a first external contact surface, which is arranged in the center on the cover part, typically acts as the first external terminal. The second external terminal is then a second external contact surface provided on the bent wall of the lower part. However, it is also possible to arrange the second external terminal for this type of switch not at the bent edge, but instead at the side of the lower part or on the lower side of the lower part.

If, on the other hand, the cover part is made of an electrically insulating material, a current transfer member in the form of a contact bridge is preferably attached to the snap-action spring disc, which contact bridge is pressed by the snap-action spring disc against two stationary counter-contacts provided on the lower side of the cover part. In this case, not only the first but also the second external contact surface is arranged on the upper side of the cover part. The two counter-contacts are connected via the cover part with the two external contact surfaces. The current then flows from one external contact surface, via the associated counter-contact, through the contact bridge into the other stationary counter-contact, and from there to the other external contact surface, so that the operating current does not flow through the snap-action spring disc itself.

This design is usually chosen when very high currents have to be switched which can no longer be easily carried through the snap-action spring disc itself.

In both design variants of the switch disclosed in DE 10 2015 114 248 B4, a bimetal disc, which lies force-free in the switching mechanism when below its switching temperature, is provided for the temperature-dependent switching function.

In the context of this disclosure, a bimetal part refers to a multi-layer, active, sheet-like component of two, three or four inseparably bonded components with different coefficients of thermal expansion. The joints between the individual layers of metal or metal alloy are materially bonded or form-fitted, and are, for example, fabricated by rolling.

Such a bimetal part has a first stable geometric configuration in its low temperature position and a second stable geometric configuration in its high temperature position, between which positions it switches depending on the temperature in a hysteresis-like manner. If the temperature changes beyond its response temperature or below its return temperature, the bimetal part snaps over to the other geometric configuration. The bimetal part is therefore often referred to as a snap-action disc, wherein it typically has an elongated, oval or circular shape when viewed from above.

If the temperature of the bimetal part, which is typically designed as a bimetal disc, rises above the response temperature as a result of a rise in temperature of the device to be protected, the bimetal disc snaps from its low-temperature configuration to its high-temperature configuration. The bimetal disc thereby acts against the snap-action spring disc in such a way that it lifts the movable contact part from the stationary counter-contact or the current transfer member from the two stationary counter-contacts, so that the switch opens and the device to be protected is switched off and can no longer heat up.

In these designs, the bimetal disc is preferably mounted mechanically force-free below its transition temperature, wherein the bimetal disc is also not used to carry the current. This has the advantage that the bimetal disc exhibits a longer mechanical service life and that the switching point, that is the transition temperature of the bimetal disc, does not change even after a large number of switching operations.

If the requirements for the mechanical reliability and/or the stability of the response temperature are low, the bimetal disc can also take over the function of the snap-action spring disc and, potentially, also of the current transfer member, so that the switching mechanism comprises only one bimetal disc, which then carries the movable contact part or comprises two contact surfaces instead of the current transfer member. In this case, the bimetal disc not only provides the closing pressure of the switch, but also carries the current when the switch is in the closed state.

In most temperature-dependent switches, the housing is usually protected against the ingress of contamination by a seal, which is applied before or after joining the connecting lugs or connecting cables to the external terminals.

Molding the external terminals with a single-component thermosetting plastic is disclosed in DE 41 39 091 A1. Casting the connecting lugs with an epoxy resin is furthermore disclosed in DE 10 2009 039 948 A1. It is also known to apply an impregnating varnish or protective varnish to the switches after soldering to the connecting cables or connecting lugs.

To prevent varnish, resin or other liquids from penetrating into the inside of the housing, the cover part of the switch disclosed in DE 196 23 570 A1 is provided with a sealing means in the form of a circumferential bead which runs radially outside on the lower side of the cover part. When the upper section of the circumferential wall of the lower part is bent, this circumferential bead constricts the insulating foil. While this does provide better sealing, in many cases varnish nevertheless does penetrate into the inside of the housing. The insulating foil lying between the lower part and the cover part is pulled up laterally between the wall of the lower part and the cover part, and its edge section is bent over onto the upper side of the cover part. The stiff insulating foil becomes rippled by the bending over, and forms rosettes which cannot be reliably sealed by the upper section of the circumferential wall of the lower part that is pressed flat onto them. There is a risk that the finishing varnish penetrates inside the switch through the rosettes. DE 196 23 570 A1 attempts to reduce this problem through the bead that has already been mentioned.

DE 10 2013 102 089 B4 describes a switch as it is known in principle from DE 196 23 570 A1. This switch comprises a spacer ring between the shoulder in the lower part and the cover part, which permits a larger contact gap between the movable contact part and the stationary counter-contact. To overcome the sealing problem known from the switch disclosed in DE 196 23 570 A1, the edge region of the insulating foil in this switch is given V-shaped incisions from the outside, whereby the ripple is greatly reduced, so improving the sealing.

DE 10 2013 102 006 B4 also describes a switch of similar design. This switch comprises a cover part of positive temperature coefficient material (PTC material). Due to the poor resistance to compression of this PTC cover, the radially inwardly bent upper section of the circumferential wall of the lower part cannot provide sufficient sealing in the known switch against the ingress of contamination, for which reason the bent upper section of the circumferential wall must be sealed against the upper side of the cover part with silicone, which leads frequently to problems. DE 10 2013 102 006 B4 solves this problem in that a covering foil is provided which only lies on the upper side of the PTC cover, and into which the upper section of the circumferential wall of the lower part which is bent and lies flat against the covering foil, penetrates. The front side of the upper section of the circumferential wall faces away from the covering foil. However, the upper section of the circumferential wall of the lower part, which is lying flat, frequently does not provide the desired sealing.

A switch can also be equipped with a covering foil and an insulating foil, as is illustrated, e.g., by DE 10 2013 102 089 B4. An insulating covering foil, e.g. made of Nomex®, is arranged on the upper side of the cover part of this switch, extending with its edge radially outwards as far as the insulating foil, which consists, e.g., of Kapton®. Nomex® and Kapton® consist of aramid paper and of aromatic polyimides, respectively.

In spite of the various sealing measures, sealing problems continue to occur with the known switches, due in part to the fact that, as a result of the bending of the upper section of the circumferential edge of the lower part, the relatively stiff insulating foil cannot achieve a lasting seal.

In the case of the switch disclosed in DE 10 2015 114 248 B4 mentioned at the outset, this sealing problem is solved by a circumferentially closed cutting burr formed integrally with the shoulder in the lower part, wherein this cutting burr penetrates into the insulating foil (if present) from below or directly into the cover part from below. By the penetration of this circumferentially closed cutting burr into the insulating foil or the cover part, a secure seal is achieved between the lower part and the cover part.

The cutting burr is generated during the production of the lower part. It is formed integrally with the shoulder in the lower part. In this case, the lower part is usually produced as a turned part, so that the cutting burr is a turning groove which is generated during the turning of the lower part.

However, in order to ensure sufficient tightness, this turning groove must be manufactured very precisely. A production of the lower part including this turning groove that is to be manufactured precisely is very complex and thus increases the production costs.

SUMMARY

It is an object to eliminate or at least to reduce the above-mentioned sealing problems in a structurally simple and inexpensive way.

According to a first aspect, a temperature-dependent switch is provided, which comprises:

a housing that comprises (i) a cover part having a lower side and an upper side, (ii) an electrically conductive lower part, and (iii) an insulating foil that is arranged between the lower side of the cover part and the lower part, wherein a first external contact surface is arranged on the upper side of the cover part, a second external contact surface is provided externally on the housing, and wherein the switch further comprises a circumferential cutting burr that penetrates into the insulating foil, the cutting burr being arranged on a sealing ring that is connected to the lower part by means of a non-positive, positive and/or firmly bonded connection; and a temperature-dependent switching mechanism that is arranged in the housing and that, depending on its temperature, establishes or opens an electrically conductive connection between the first external contact surface and the second external contact surface.

According to a second aspect, a temperature-dependent switch is presented which comprises:

a housing that comprises (i) a cover part having a lower side and an upper side, and (ii) an electrically conductive lower part, wherein at least a part of the cover part comprises an electrically insulating material, wherein a first external contact surface and a separate second external contact surface are arranged on the upper side of the cover part, and wherein the switch further comprises a circumferential cutting burr that penetrates into the cover part, the cutting burr being arranged on a sealing ring that is connected to the lower part by means of a non-positive, positive and/or firmly bonded connection; and a temperature-dependent switching mechanism that is arranged in the housing and that, depending on its temperature, establishes or opens an electrically conductive connection between the first external contact surface and the second external contact surface.

Thus, the cutting burr either penetrates into the insulating foil from below, if there is one between the lower part and the cover part, or it penetrates directly into the cover part, which is then made of insulating material. The cutting burr serves as a mechanical barrier, which creates a kind of seal that acts by penetrating the cutting burr into the insulating foil or cover part above it. Therefore, the sealing effect is achieved by a structural element that provides a mechanical barrier against the ingress of dirt, i.e. it reliably retains both particles and fluids. Creep paths for liquids, which could otherwise occur between the cover part and the lower part, are thus almost completely avoided, so that when the switch is impregnated with protective varnish, this protective varnish or other impurities cannot creep into the interior of the switch.

The cutting burr also ensures that no liquid can enter the inside of the switch during resinification. Even when soldering connecting leads to the switch, the penetration of the cutting burr into the insulating foil or the cover part prevents solder or corresponding liquids from getting into the interior of the switch.

An advantage of the herein presented switch, e.g. compared to the switch disclosed in DE 10 2015 144 248 B4, is that the cutting burr is arranged on a sealing ring which is connected to the lower part by means of a non-positive, positive and/or firmly bonded connection. The cutting burr of the herein presented switch is therefore not formed integrally with the lower part of the switch, as disclosed in DE 10 2015 114 248 B4, but is arranged on an extra sealing ring.

This sealing ring together with the cutting burr formed on it can be easily inserted into the lower part during the production of the switch and connected to the lower part, for example by clamping, welding, soldering or flanging.

The cutting burr itself is much easier to form on the sealing ring than on the lower part of the switch, since the sealing ring itself already has a very simple geometric shape to which a cutting burr can be attached without any problems.

Since the cutting burr is not formed integrally with the lower part, the lower part can also be produced in a much easier and more economic way. The lower part can be produced as a punched part, for example. In principle, the sealing ring and the cutting burr on it can also be produced as a punched part.

This results in a significant reduction of the manufacturing costs of the switch, while still having the same sealing properties as the switch disclosed in DE 10 2015 114 248 B4.

Preferably, the cutting burr is circumferentially closed in itself. This results in an even better sealing effect, because a self-contained seal in the form of a ring-shaped barrier is created during the assembly of the new switch.

If an insulating foil is arranged between the lower part and the cover part, the cover part can be made of an electrically conductive material. In this case, the insulating foil runs inside the switch between the lower part and the cover part and laterally between the circumferential wall of the lower part and the cover part and its edge area is bent over on the upper side of the cover part. In this way, the cover part and the lower part are electrically insulated from each other.

If the cover part consists of electrically insulating material, the insulating foil is not necessary per se, but it may still be provided to ensure a reliable sealing of the switch in the manner described above. The insulating foil then has to be provided only between the lower side of the cover part and the shoulder of the lower part, and does not have to extend up to the upper side of the cover part. It can thus be formed as an insulating ring that rests on the lower part. In principle, however, the insulating foil can then also be dispensed with completely. The cover part made of electrically insulating material can also rest with its lower side directly on the lower part, so that in this case the cutting burr penetrates directly into the cover part from the lower side.

According to a refinement, the cutting burr provided on the sealing ring protrudes from an upper side of the sealing ring with a height that is lies 10 μm and 50 μm, preferably between 20 μm to 30 μm.

This height has been found appropriate, since the insulating foil typically used has a thickness in a range below 100 μm, so that the cutting burr penetrates to a maximum of half of this thickness into the insulating foil, so that the electrical insulation effect of the insulating foil is retained.

At its base, the cutting burr preferably has a width that is between 70% and 120% of the height of the cutting burr. In general, it is preferred that the cross section of the burr is substantially triangular in shape, especially preferably an isosceles triangle.

According to another refinement, the sealing ring, on which the cutting burr is formed, is glued, soldered or welded to the lower part of the switch.

In this case, the sealing ring and the cutting burr are inserted into the lower part and subsequently joined to it by gluing, soldering or welding. This ensures a stable and tight connection between the sealing ring and the lower part of the housing. The production is therefore very simple.

Furthermore, it is preferred that the lower part comprises a circumferential wall, the upper section of which overlaps the cover part, and that a circumferential shoulder is provided in the lower part, wherein the cover part rests directly or indirectly on the circumferential shoulder, wherein the upper section of the lower part presses the cover part onto the circumferential shoulder.

A similar construction type is already disclosed in DE 10 2015 144 248 B4. It has the advantage that no further components are needed to fix the cover part to the lower part. The cover part is simply attached to the lower part by the upper edge of the lower part being bent over onto the cover part. The bent upper edge of the lower part presses the cover part onto the circumferential shoulder provided in the lower part, on which circumferential shoulder the cover part rests either directly or indirectly (e.g. with the insulating foil interposed).

The sealing ring with the cutting burr arranged on it is preferably arranged in the area of the circumferential shoulder provided in the lower part. It can, for example, be arranged on, next to or in this shoulder.

According to a refinement, a circumferential recess is provided in the circumferential shoulder, into which circumferential recess the sealing ring is flanged or pressed.

This recess is preferably designed as a groove-shaped recess in the circumferential shoulder. The sealing ring including the cutting burr arranged thereon is inserted into this recess and secured therein by flanging. It is also possible to provide a press fit so that the sealing ring is pressed into the recess. A positive and/or non-positive connection is created, which holds the sealing ring including the cutting burr captive to the lower part of the switch housing.

Of course, it is also possible to connect the sealing ring not only with a positive or non-positive fit to the circumferential shoulder, but also to provide a firmly bonded connection between the two components, e.g. by means of gluing, soldering or welding.

The sealing ring is preferably designed as an inlay or insert that is inserted into the lower part and connected to it by means of a non-positive, positive and/or firmly bonded connection.

According to another refinement, the lower part, in particular the circumferential shoulder of the lower part, is made of a material that has a higher hardness than a material from which the sealing ring is made.

This has the advantage that the sealing ring and the cutting burr can be more easily attached to the lower part by means of a positive connection. This facilitates particularly the flanging or pressing of the sealing ring into the lower part of the switch.

According to another refinement, the lower part is provided with a circumferential notch and the sealing ring comprises on its lower side facing the circumferential notch an annular bead or feather key which is fitted, pressed or flanged into the circumferential notch.

Such a positive connection is similar to a groove-and-feather key-connection. This guarantees a stable fixture of the sealing ring on the lower part. In addition to this type of groove-and-feather key-connection, the sealing ring can be connected to the lower part by means of a firmly bonded connection to further increase the mechanical stability of the connection.

The circumferential notch is preferably integrated in the circumferential shoulder in the lower part.

Furthermore, it is preferred if the insulating foil consists of polyimide, preferably an aromatic polyimide. Such protective films are marketed, for example, under the trade name Kapton®. An insulating foil made of this material is characterized in that it is "stretchable", i.e. it stretches somewhat when the cover part is inserted into the lower part, and that it can still be easily bent over to the upper side of the cover part around the front side of the cover part, wherein, furthermore, the necessary dielectric strength is achieved.

It is preferred that the second external contact surface is arranged on the upper section of the circumferential wall, where then preferably the switching mechanism carries a movable contact part that interacts with a stationary counter-contact which is arranged on the lower side of the cover part and interacts with a first external contact surface which is arranged on the upper side.

Alternatively, it is preferred if the second external contact surface is arranged on the upper side of the cover part, wherein preferably the switching mechanism then carries a current transfer member that interacts with two stationary counter-contacts arranged on the lower side of the cover part and interacting with the two external contact surfaces arranged on the upper side. It is an advantage here that the switch can also be designed for switching and carrying very high currents, for which purpose the two stationary counter-contacts interact with a current transfer member in the form of a contact bridge or contact plate, so that the operating current of the device to be protected does not flow through the snap-action spring disc, or even the bimetal snap-action disc, but only through the current transfer member.

Regardless of the construction type of the switch, it is preferred that the switching mechanism comprises a bimetal part. The bimetal part can be a round, preferably circular bimetal snap-action disc, wherein it is also possible to use an elongated bimetal spring clamped on one end as the bimetal part. In simple switches, this bimetal part can also be used to carry current.

Furthermore, it is preferred that the switching mechanism comprises an additional snap-action spring disc. This snap-action spring disc can, for example, carry the movable contact part and can carry the current through the closed switch and provide the contact pressure in the closed state. In this way, the bimetal part is relieved both of carrying the current and also of the mechanical stress in the closed state.

If the switching mechanism comprises a current transfer member that interacts with two stationary counter-contacts, it is again possible either for only one bimetal part to be provided, which then generates the closing pressure and performs the opening function, or, additionally, a spring part can be provided that applies the closing force, so that the bimetal part is only mechanically stressed when it opens the switch.

The herein presented switch is particularly suitable for at least approximately round temperature-dependent switches, i.e. which are round, circular or oval in the plan view of the lower part or cover part, although this is not necessary. The sealing ring is preferably adapted to the shape of the switch. It is therefore preferably round, circular or oval when viewed from above.

It is clear that the features referred to above and yet to be explained below can be used not only in the respective given combinations, but also in other combinations or alone without leaving the spirit and scope of the present disclosure.

DESCRIPTION OF PREFERRED EMBODIMENTS

Figure 1:
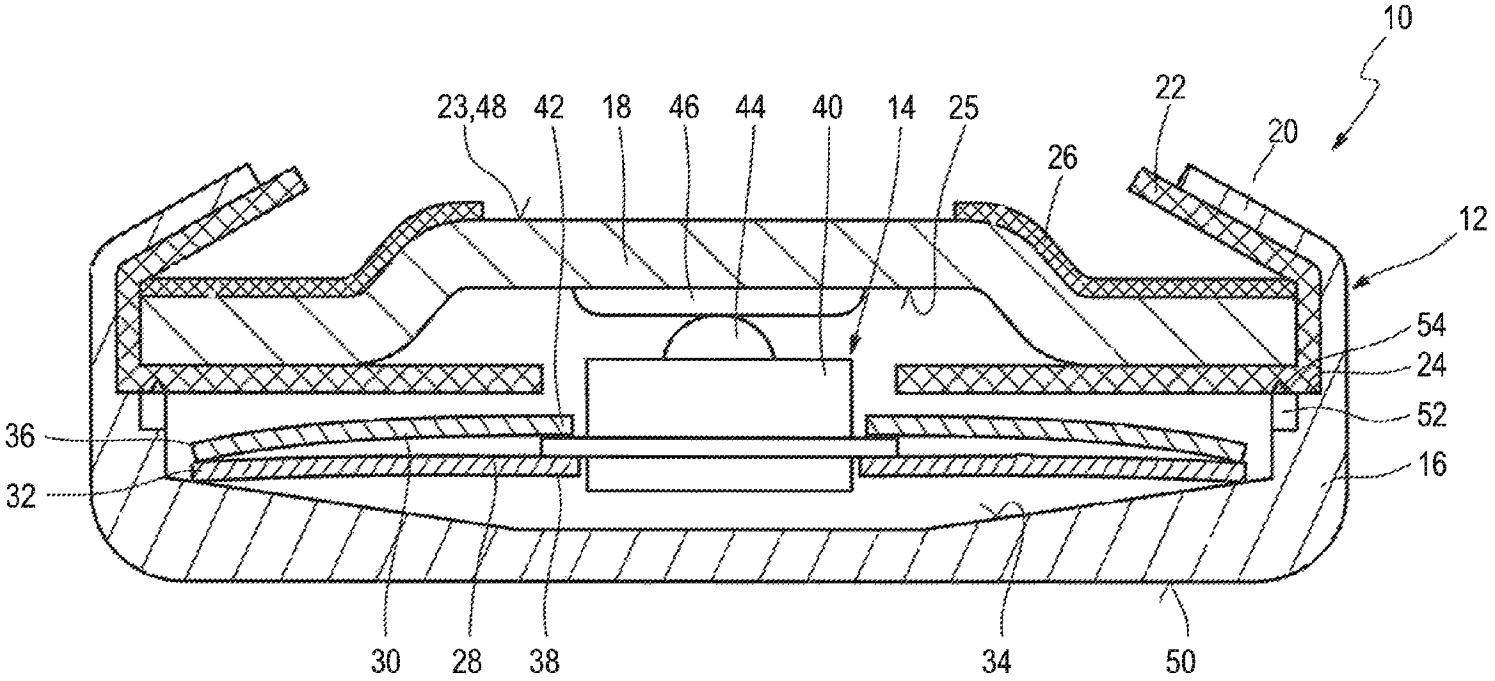
FIG. 1 shows a schematic sectional view of a first embodiment of the switch in a first switching position.

FIG. 1 shows a schematic sectional side view of a switch 10, which is rotationally symmetrical in top view and preferably has a circular shape.

The switch 10 comprises a housing 12, in which a temperature-dependent switching mechanism 14 is arranged. The housing 12 comprises a pot-like lower part 16 and a cover part 18, which is held on the lower part 16 by a bent or flanged rim 20.

In the first embodiment shown in FIG. 1, both the lower part 16 and the cover part 18 are made of an electrically conductive material, preferably metal. The cover part 18 lies on a shoulder 24 inside the lower part 16 with an interposed insulating foil 22. The upper edge 20 of the lower part 16 is bent radially inwards in such a way that it presses the interposed insulating foil 22 and the cover part 18 onto the circumferential shoulder 24 if it is bent further towards the upper side of the cover part 18 compared to the situation shown schematically in FIG. 1.

The insulating foil 22 provides an electrical insulation of the cover part 18 against the lower part 16. In addition, the insulating foil 22 also provides a mechanical seal that prevents liquids or impurities from entering the inside of the housing from the outside.

The insulating foil 22 runs inside the housing 12 parallel to the cover part 18 along the lower side 25 of the cover part, from where it is led laterally between the cover part 18 and the circumferential shoulder 24 up to the upper side 23 of the cover part 18 and out of the housing 12. The bent or flanged upper edge 20 of the lower part 16 lies flat on the upper edge section of the insulating foil 22 and presses it towards the upper side 23 of the cover part 18.

On the upper side 23 of the cover part 18, a further insulating cover 26 is provided, which extends radially outwards up to the insulating foil 22.

The switching mechanism 14 comprises a temperature-independent spring part 28, which is designed as a spring disc, and a temperature-dependent snap-action part 30, which is designed as a bimetal snap-action disc.

The spring part 28 is preferably designed as a bistable spring disc. Accordingly, the spring disc 28 has two temperature-independent stable geometric configurations. The first geometric configuration is shown in FIG. 1.

The temperature-dependent bimetal snap-action disc 30 is preferably designed as a bistable snap-action disc. The snap-action disc 30 has two temperature-dependent configurations, a geometrical high temperature configuration and a geometrical low temperature configuration. In the first switching position of the switching mechanism 14 shown in FIG. 1, the snap-action disc 30 is in its low-temperature configuration.

The spring disc 28 lies with its edge 32 on an inner bottom surface 34 of the lower part 16. The inner bottom surface 34 is substantially concave in shape and is slightly raised at the point where the edge 32 of the spring disc 28 rests in the first switching position shown in FIG. 1 compared to the central area of the inner bottom surface 34. The snap-action disc 30 lies with its edge 36 on the spring disc 28 in its low temperature configuration shown in FIG. 1.

The spring disc 28 is fixed with its center 38 to a movable contact member 40 of the switching mechanism 14. The bimetal snap-action disc 30 is also fixed with its center 42 to this contact member 40. In this way, the temperature-dependent switching mechanism 14 is a captive unit comprising the contact member 40, the spring disc 28 and the bimetal snap-action disc 30. During the assembly of the switch 10, the switching mechanism 14 can thus be inserted as a unit directly into the lower part 16.

On its upper side, the movable contact member 40 comprises a movable contact part 44. The movable contact part 44 interacts with a stationary counter-contact 46, which is arranged at the lower side 25 of the cover part 18. In this embodiment, the upper side 23 of the cover part 18, which is connected to the stationary counter-contact 46 in an electrically conductive manner, serves as first external contact surface 48. The outer side of the lower part 16 serves as second external contact surface 50. For example, the outer bottom surface or the outer side of the bent upper edge 20 of the lower part 16 can serve as second external contact surface 50.

In the closed switching position of switch 10 shown in FIG. 1, the movable contact part 44 is pressed against the stationary counter-contact 46 by the spring disc 28. Since electrically conductive spring disc 28 is, with its edge 32, in contact with the lower part 16, an electrically conductive connection is established between the two external contact surfaces 48, 50.

Figure 2:
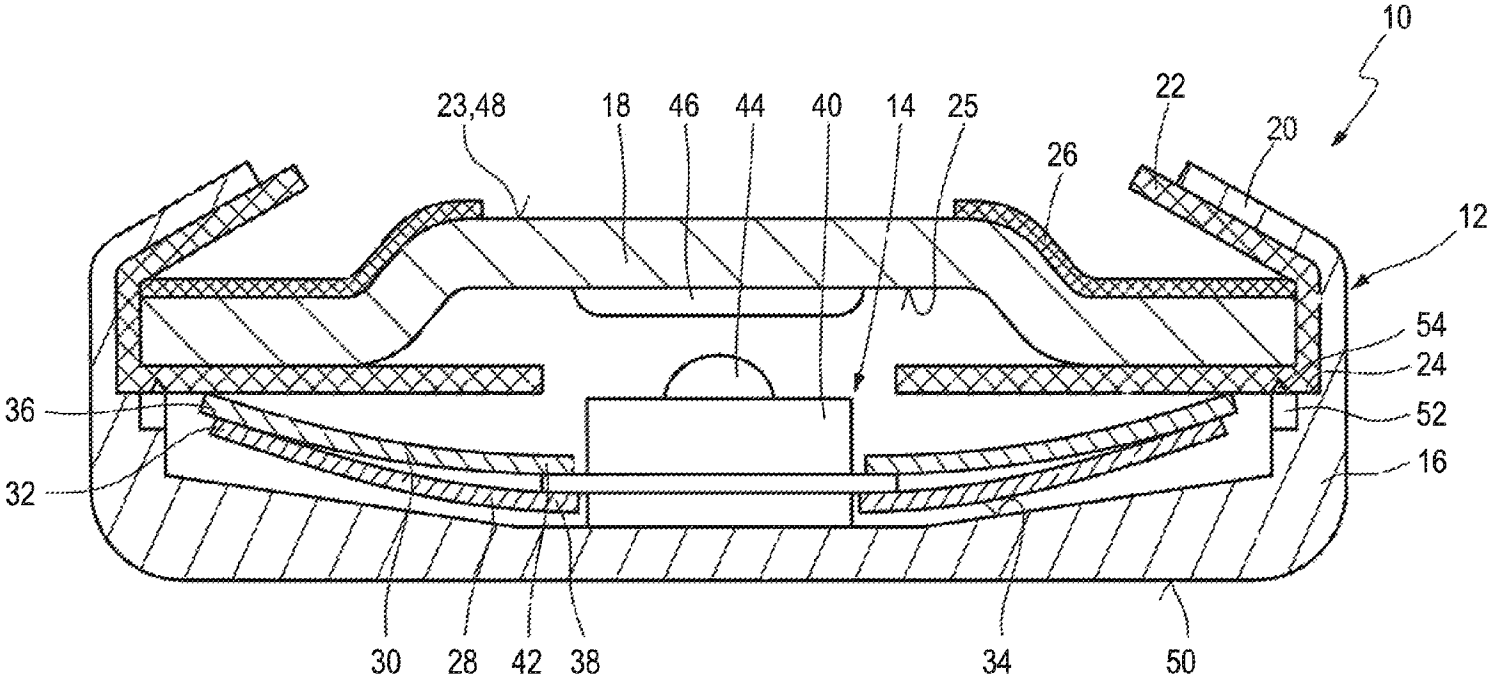
FIG. 2 shows a schematic sectional view of the first embodiment of the switch shown in FIG. 1, in a second switching position.

If the temperature inside the switch 10 now increases above the switching temperature of the bimetal snap-action disc 30, the latter snaps from its convex low temperature configuration shown in FIG. 1 to its concave high temperature configuration shown in FIG. 2.

In the high-temperature configuration shown in FIG. 2, the bimetal snap-action disc 30 has its edge 36 supported on the lower side of the insulating foil 22 and pushes the movable contact member 40 downwards with its center 42. This lifts the movable contact member 44 off the stationary counter-contact 46. The spring disc 28 thereby snaps from its first geometrically stable configuration shown in FIG. 1 to its second geometrically stable configuration shown in FIG. 2.

Since switch 10 is now open and the power supply to the device to be protected is interrupted, the device to be protected and therefore also switch 10 can cool down again. When the temperature inside the switch 10 then cools down to a temperature below the reset temperature of the bimetal snap-action disc 30, it snaps back from its high temperature configuration shown in FIG. 2 to its low temperature configuration shown in FIG. 1. The spring disc 28 also snaps back into its first geometrically stable configuration and brings the movable contact part 44 back into contact with the stationary counter-contact 46. The switch 10 or the electric circuit is then closed again.

In order to improve the sealing of the inside of the housing, a sealing ring 52 is arranged in the area of the circumferential shoulder 24, wherein a cutting burr 54 is provided on the upper side of the sealing ring 52. The cutting burr 54 is preferably designed as a circumferentially closed cutting burr that is integrally connected to the sealing ring 52.

Sealing ring 52 including the cutting burr 54 arranged thereon form a kind of inlay that is inserted into the lower part 16 in the area of the circumferential shoulder 24.

The sealing ring 52 including the cutting burr arranged on it is preferably produced as a punched part. This punched part is connected to the lower part 16 by means of a positive, non-positive and/or firmly bonded connection in the area of the circumferential shoulder 24 (e.g. on, next to, below or in the circumferential shoulder 24).

The lower part 16 and the sealing ring 52 can thus be produced as two separate components that are subsequently joined together. This enables a very easy production of both components, as both the lower part 16 and the sealing ring 52 including the cutting burr 54 arranged on it can be produced as low-cost punched parts.

Figure 3:
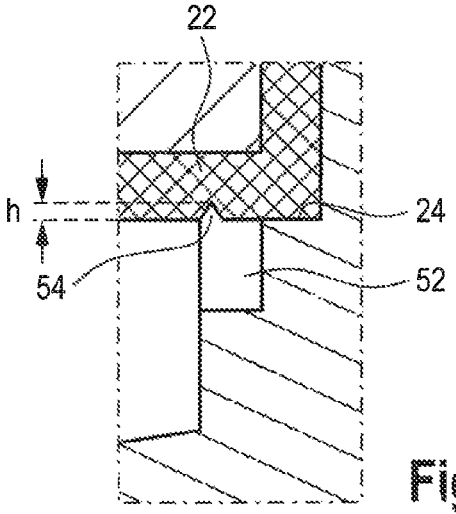
FIG. 3 shows a schematic sectional view in detail of a first connection variant of a sealing ring with a lower part of the switch.
Figure 4:
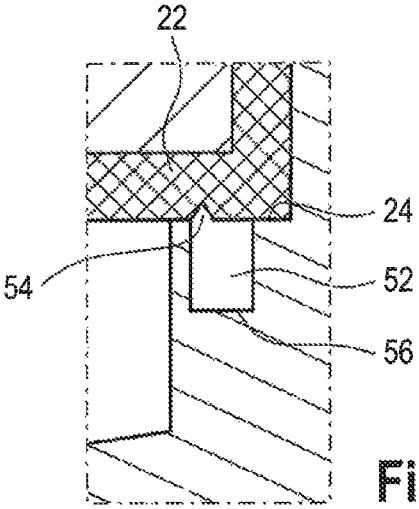
FIG. 4 shows a schematic sectional view in detail of a second connection variant of the sealing ring with the lower part of the switch.
Figure 5:
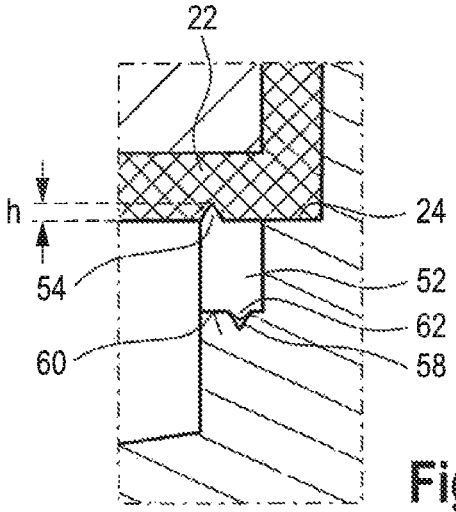
FIG. 5 shows a schematic sectional view in detail of a third connection variant of the sealing ring with the lower part of the switch.

FIGS. 3-5 show three different embodiments of how the sealing ring 52 including the cutting burr 54 arranged on it can be attached on the lower part 16.

According to the first embodiment shown in FIG. 3, the sealing ring 52 is attached to the lower part 16 by means of a firmly bonded connection. For example, the sealing ring 52 is glued, soldered, or welded to the lower part 16 in the area of the shoulder 24. In addition, the sealing ring 52 can be fitted into the base 16 in a kind of press fit. This additionally stabilizes the connection between sealing ring 52 and base 16. In this respect, it is particularly preferred that the circumferential shoulder 24 or the lower part 16 is made of a material that is harder than the material from which the sealing ring 52 is made.

FIG. 4 shows another embodiment in which the sealing ring 52 is arranged in a circumferential recess 56, which is inserted into the shoulder 24 of the lower part 16. For example, the circumferential recess 56 can be a groove-shaped recess that is inserted into shoulder 24 from above and into which the sealing ring 52 can be pressed or flanged.

In the third embodiment shown in FIG. 5, a circumferential notch 58 is provided in the lower part 16, into which notch a bead 62 located on the lower side 60 of the sealing ring is fitted, pressed or flanged. In the embodiment shown in FIG. 5, the notch 58 has an substantially V-shaped cross-section. The bead 62, on the other hand, has a substantially semicircular or U-shaped cross-section. However, it goes without saying that other cross-sectional shapes can also be provided for the notch 58 and the bead 62. The cross-sectional shapes of notch 58 and bead 62 can also be equivalent to each other. However, it is preferred that the bead 62 has an oversize compared to the notch 58.

All three embodiments shown in FIGS. 3-5 have in common that the cutting burr 54 provided on the upper side of the sealing ring 52 cuts into the insulating foil 22. As a result, the cutting burr 54 forms a mechanical barrier that prevents liquids or other impurities from entering the interior of housing 12 between the lower side of the insulating foil 22 and the lower part 16.

The cutting burr 54 preferably protrudes above shoulder 24 with a height h (see FIG. 3) that lies between 10 μm and 50 μm. The insulating foil 22 typically has a thickness in the range of 100 μm. Thus, the cutting burr 54 cuts into the insulating foil 22 to a maximum of 50% of the thickness. The electrically insulating properties of the insulating foil 22 are therefore maintained.

Figure 6:
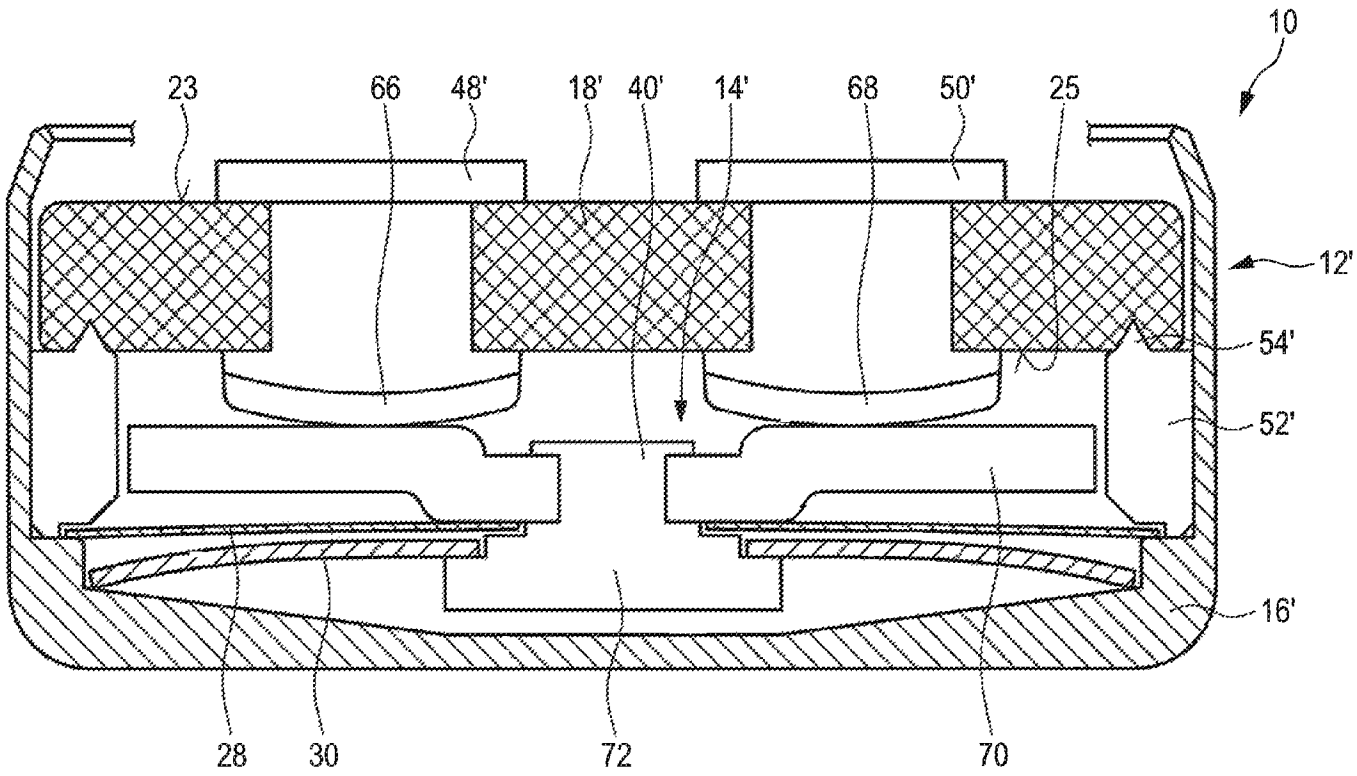
FIG. 6 shows a schematic sectional view of a second embodiment of the switch in a first switching position.
Figure 7:
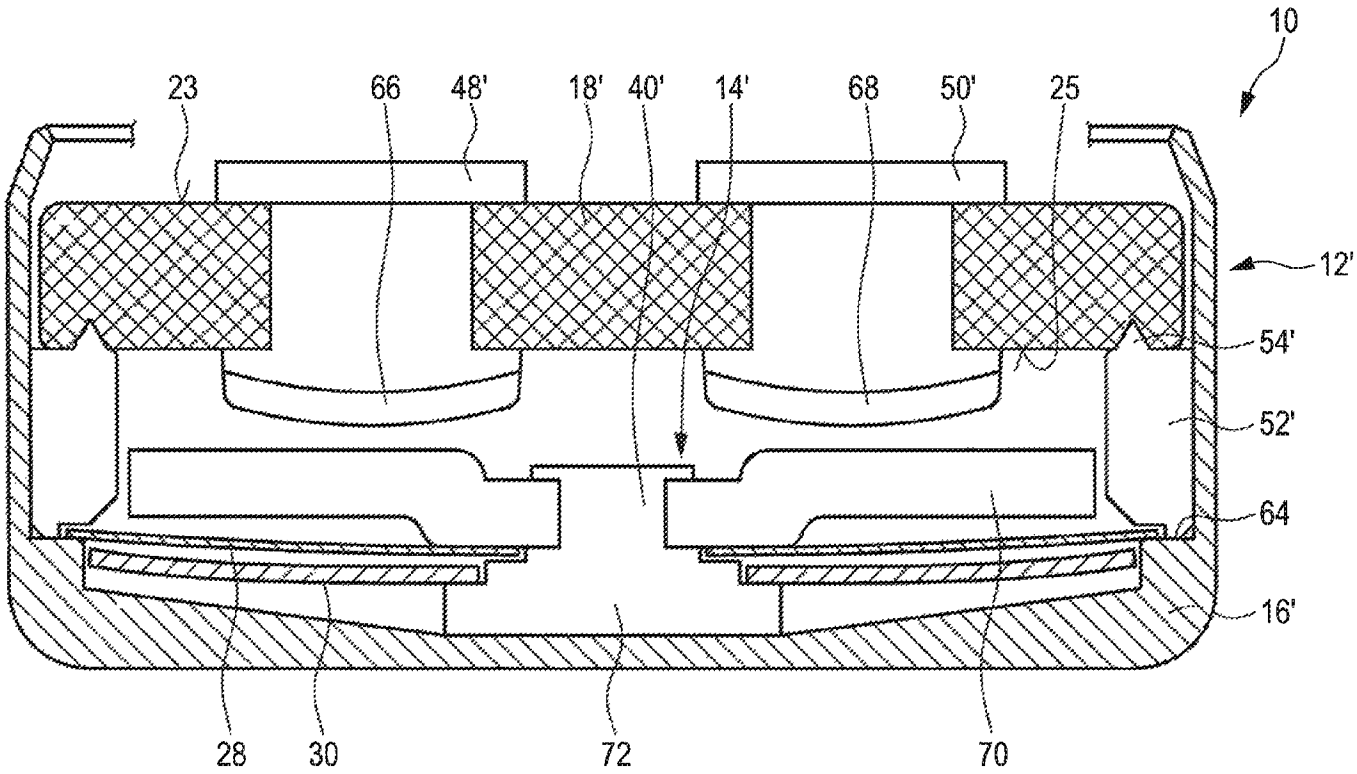
FIG. 7 shows a schematic sectional view of the second embodiment of the switch shown in FIG. 6, in a second switching position.

FIGS. 6 and 7 show a second embodiment of the switch 10. FIG. 6 shows the closed switching position of the switch 10. FIG. 7 shows the open switching position of the switch 10.

The switch 10 according to the second embodiment shown in FIGS. 6 and 7 differs from the first embodiment shown in FIGS. 1 and 2 mainly in the construction of the housing 12' and the construction of the switching mechanism 14'.

The lower part 16' is again made of electrically conductive material. The flat cover part 18' is made of electrically insulating material. Accordingly, no insulating foil 22, which must be inserted between the lower part 16' and the cover part 18', is necessary here. In principle, however, an insulating foil 22 as shown in FIGS. 1 and 2 can also be provided for the switch construction shown in FIGS. 6 and 7. In this case, however, it would only serve to mechanically seal the inside of the housing and not to electrically insulate the cover part 18' from the lower part 16'.

Between the cover part 18' and the lower part 16' there is also a sealing ring 52', on the upper side of which a cutting burr 54' is arranged. In this embodiment, the cutting burr 54' penetrates directly into the lower side 25 of the cover part 18'. As before, it serves as a mechanical barrier to prevent impurities from penetrating into the inside of the housing of the switch 10. Accordingly, the cutting burr 54' is also preferably designed as a circumferential, closed cutting burr.

The sealing ring 52' is inserted into the lower part 16'. Its lower side lies on a circumferential shoulder 64 running around the inside of the lower part 16'. The sealing ring 52' thus also acts as a spacer ring that keeps the upper part 18' at a distance from the lower part 16'.

The sealing ring 52' is, similar to the first embodiment of the switch 10 shown in FIGS. 1 and 2, connected to the lower part 16' by means of a non-positive, positive and/or firmly bonded connection. As already mentioned above, the sealing ring 52' can be glued, welded or soldered to the lower part 16', for example. Likewise, the sealing ring 52' can also be connected to the lower part 16' by flanging it with a positive and/or non-positive fit. Furthermore, it is possible to clamp the sealing ring 52' by means of a press fit in the lower part 16'. The fastening options shown in FIG. 3-5 therefore also apply equally to the fastening of the sealing ring 52' to the lower part 16'.

In the second embodiment of the switch 10 shown in FIGS. 6 and 7, the two external contact surfaces 48', 50' are arranged on the upper side 23 of cover part 18'. These two external contact surfaces 48', 50' are formed on the upper side of two rivets arranged at a distance from each other and extending through the cover part 18'. On the lower side of each rivet, there is a stationary contact 66, 68, which protrudes downward from the lower side 25 of the cover part 18'.

The switching mechanism 14' is also slightly different from the previous one. The movable contact member 40' comprises a current transfer member 70, which is designed as a contact plate, the upper side of which is coated with an electrically conductive coating, so that it provides an electrically conductive connection between the two contacts 66, 68, as shown in FIG. 6.

The current transfer member 70 is connected to the spring disc 28 and the bimetal snap-action disc 30 via a rivet 72, which is also to be regarded as part of the contact member 40'.

Similarly as before, the bimetal snap-action disc 30 snaps over from the low temperature configuration shown in FIG. 6 to the high temperature configuration shown in FIG. 7 when its switching temperature is reached, which also causes the spring disc 28 to snap over from its first geometric position shown in FIG. 6 to its second geometric position shown in FIG. 7. The current transfer member 70 is lifted off the two stationary contacts 66, 68, so that the circuit is interrupted.

An advantage of the switch design shown in FIGS. 6 and 7 is that, in contrast to the first embodiment of switch 10 shown in FIG. 1-2, no current flows through either the spring disc 28 or the bimetal snap-action disc 30 when switch 10 is closed. This current flows only from the first external contact surface 48' via the first stationary contact 66, the current transfer member 70 and the second stationary contact 68 to the second external contact surface 50'.

It is to be understood that the foregoing is a description of one or more preferred exemplary embodiments of the invention. The invention is not limited to the particular embodiment(s) disclosed herein, but rather is defined solely by the claims below. Furthermore, the statements contained in the foregoing description relate to particular embodiments and are not to be construed as limitations on the scope of the invention or on the definition of terms used in the claims, except where a term or phrase is expressly defined above. Various other embodiments and various changes and modifications to the disclosed embodiment(s) will become apparent to those skilled in the art. All such other embodiments, changes, and modifications are intended to come within the scope of the appended claims.

As used in this specification and claims, the terms "for example," "e.g.," "for instance," "such as," and "like," and the verbs "comprising," "having," "including," and their other verb forms, when used in conjunction with a listing of one or more components or other items, are each to be construed as open-ended, meaning that the listing is not to be considered as excluding other, additional components or items. Other terms are to be construed using their broadest reasonable meaning unless they are used in a context that requires a different interpretation.

What is claimed is:

1. A temperature-dependent switch, comprising:

a housing that comprises (i) a cover part having a lower side and an upper side, (ii) an electrically conductive lower part, and (iii) an insulating foil that is arranged between the lower side of the cover part and the electrically conductive lower part, wherein a first external contact surface is arranged on the upper side of the cover part, a second external contact surface is provided externally on the housing, and wherein the temperature-dependent switch further comprises a circumferential cutting burr that penetrates into the insulating foil, the circumferential cutting burr being arranged on a sealing ring that is connected to the electrically conductive lower part by means of a non-positive, positive and/or firmly bonded connection; and a temperature-dependent switching mechanism that is arranged in the housing and that, depending on its temperature, establishes or opens an electrically conductive connection between the first external contact surface and the second external contact surface.

2. The temperature-dependent switch according to claim 1, wherein the circumferential cutting burr is circumferentially closed in itself.

3. The temperature-dependent switch according to claim 1, wherein the circumferential cutting burr protrudes from an upper side of the sealing ring with a height that is between 10 μm and 50 μm.

4. The temperature-dependent switch according to claim 1, wherein the sealing ring is formed integrally with the circumferential cutting burr.

5. The temperature-dependent switch according to claim 4, wherein the sealing ring is a turned part or a punched part.

6. The temperature-dependent switch according to claim 1, wherein the connection between the sealing ring and the electrically conductive lower part is a glued connection, a soldered connection or a welded connection.

7. The temperature-dependent switch according to claim 1, wherein the electrically conductive lower part comprises an upper edge, and wherein the upper edge overlaps the cover part.

8. The temperature-dependent switch according to claim 7, wherein a circumferential shoulder is provided in the electrically conductive lower part, wherein the cover part is arranged directly or indirectly on the circumferential shoulder, and wherein the upper edge of the electrically conductive lower part presses the cover part onto the circumferential shoulder.

9. The temperature-dependent switch according to claim 8, wherein a circumferential recess is provided in the circumferential shoulder, and wherein the sealing ring is arranged in the circumferential shoulder.

10. The temperature-dependent switch according to claim 1, wherein the electrically conductive lower part comprises a first material, and wherein the sealing ring comprises a second material, the first material having a higher hardness than the second material.

11. The temperature-dependent switch according to claim 1, wherein a circumferential notch is provided in the electrically conductive lower part, and wherein the sealing ring comprises on a lower side of the sealing ring facing the circumferential notch an annular bead or feather key that is fitted, pressed or flanged into the circumferential notch.

12. The temperature-dependent switch according to claim 1, wherein the temperature-dependent switching mechanism carries a movable contact part that interacts with a stationary counter-contact that is arranged on the lower side of the cover part and that interacts with the first external contact surface.

13. The temperature-dependent switch according to claim 1, wherein the temperature-dependent switching mechanism comprises a bimetal part.

14. The temperature-dependent switch according to claim 1, wherein the temperature-dependent switching mechanism comprises a snap-action spring disc.

15. A temperature-dependent switch, comprising:

a housing that comprises (i) a cover part having a lower side and an upper side, and (ii) an electrically conductive lower part, wherein at least a part of the cover part comprises an electrically insulating material, wherein a first external contact surface and a separate second external contact surface are arranged on the upper side of the cover part, and wherein the temperature-dependent switch further comprises a circumferential cutting burr that penetrates into the cover part, the circumferential cutting burr being arranged on a sealing ring that is connected to the electrically conductive lower part by means of a non-positive, positive and/or firmly bonded connection; and a temperature-dependent switching mechanism that is arranged in the housing and that, depending on its temperature, establishes or opens an electrically conductive connection between the first external contact surface and the second external contact surface.

16. The temperature-dependent switch according to claim 15, wherein the temperature-dependent switching mechanism carries a current transfer member that interacts with two stationary counter-contacts that are arranged on the lower side of the cover part and that interact with the first external contact surface and the second external contact surface.

17. The temperature-dependent switch according to claim 15, wherein the sealing ring is formed integrally with the circumferential cutting burr.

18. The temperature-dependent switch according to claim 15, wherein the connection between the sealing ring and the electrically conductive lower part is a glued connection, a soldered connection or a welded connection.

19. The temperature-dependent switch according to claim 15, wherein the electrically conductive lower part comprises an upper edge, wherein the upper edge overlaps the cover part, wherein a circumferential shoulder is provided in the electrically conductive lower part, wherein a circumferential recess is provided in the circumferential shoulder, wherein the sealing ring is arranged in the circumferential shoulder, and wherein the upper edge of the electrically conductive lower part presses the cover part onto the circumferential shoulder.

20. The temperature-dependent switch according to claim 15, wherein the temperature-dependent switching mechanism comprises a bimetal part and a snap-action spring disc.

* * * * *